US005647660A

United States Patent [19]

Lee

[11] Patent Number: 5,647,660

[45] Date of Patent: *Jul. 15, 1997

[54] MODULAR LIGHT DISPLAY APPARATUS

[76] Inventor: Kuo-Hsing Lee, 10139 Duchamp, Houston, Tex. 77036

[ * ] Notice: The term of this patent shall not extend beyond the expiration date of Pat. No. 5,442,531.

[21] Appl. No.: 502,371

[22] Filed: Jul. 14, 1995

Related U.S. Application Data

[63] Continuation-in-part of Ser. No. 247,683, May 23, 1994, Pat. No. 5,442,531.

[51] Int. Cl.[6] ..... F21V 21/00

[52] U.S. Cl. ..... 362/249; 362/153.1; 362/382; 248/156

[58] Field of Search ..... 248/49, 156, 222.11, 248/224.7, 530; 362/145, 153, 153.1, 249, 250, 252, 258, 382, 387, 391, 806–808, 122, 123, 278, 320; 439/207–210

[56] References Cited

U.S. PATENT DOCUMENTS

| | | | |
|---|---|---|---|
| 2,823,001 | 2/1958 | Whitfield | 248/49 |
| 2,924,338 | 2/1960 | Sharp | 248/156 |
| 3,339,869 | 9/1967 | Andersen | 248/156 |
| 3,404,268 | 10/1968 | Fowler | 439/208 |
| 4,462,065 | 7/1984 | Rhodes | 362/250 |
| 4,903,179 | 2/1990 | Lin | 362/249 |
| 5,003,439 | 3/1991 | Yang | 362/153 |
| 5,057,981 | 10/1991 | Bowen et al. | 362/249 |
| 5,442,531 | 8/1995 | Lee | 362/249 |

*Primary Examiner*—Alan Cariaso
*Attorney, Agent, or Firm*—Bill B. Berryhill

[57] ABSTRACT

Modular light display apparatus for mounting a string of electric lights which has a plurality of light sockets and corresponding light bulbs connected at spaced intervals to electrically conducting wire. The light display apparatus comprises two or more pre-shaped modular light holders the ends of which are removably engageable with corresponding stationarily disposed objects to provide for mounting of the string of electric lights in a display of predetermined configuration. Each of the modular light holders comprises an elongated member of generally U-shaped cross-section to provide a channel in which the string of electric lights may be disposed. A plurality of uniformly spaced holders each one of which is engageable with one of the light sockets of said string of electric lights may be provided within the channel so that when viewed from at least one side of the modular light holder, the light sockets are hidden within the channel and the light bulbs project upwardly from the channel.

10 Claims, 3 Drawing Sheets

G

MODULAR LIGHT DISPLAY APPARATUS

CROSS-REFERENCE TO RELATED APPLICATION

This application is a continuation-in-part of U.S. application Ser. No. 08/247,683, filed May 23, 1994, now U.S. Pat. No. 5,442,531.

BACKGROUND OF THE INVENTION

1. Field of the Invention

The present invention pertains to apparatus for mounting a string of electric lights in a display of pre-determined configuration. More specifically, the present invention pertains to pre-shaped modular light holders which are removably engageable with stationary objects to provide for mounting of a string of electric lights in a display of pre-determined configuration.

2. Brief Description of the Prior Art

Various kinds of electric lights are manufactured which include a plurality of light bulbs and corresponding light sockets connected at spaced intervals to electrically conducting wire. The lamps may be connected in series or parallel. Typical of such lights are the kind sold for Christmas or other holidays which allow a multiplicity of lights to be strung around a Christmas Tree or on other objects as decoration. Such lights may also be used in commercial lighting displays.

Frequently, displayers of electric lights wish to use the lights in outlining, highlighting or actually defining a particularly shaped object or objects. For example, at Christmas, the displayer may wish to use the lights in spelling words such as "Merry Christmas" or "Happy Holidays" or they may wish to outline the representation of a Christmas Tree or a reindeer. A displayer may simply want to provide a display of uniform shapes or designs such as circles, scallops, etc. along the edge of a sidewalk, flower bed, etc. Although light bulbs may be uniformly spaced at intervals on electric wiring, they are not easily held or placed in such a display of pre-determined configuration.

Various apparatus have been designed for displaying electric lights in pre-determined configurations. Examples of such may be seen in the following U.S. patents: U.S. Pat. No. 2,595,929; U.S. Pat. No. 3,404,268; U.S. Pat. No. 3,836,760; U.S. Pat. No. 4,439,818; U.S. Pat. No. 4,769,749; U.S. Pat. No. 5,057,981. In all these patents some type of support is provided to position lights, particularly Christmas Tree type lights, in a design display. Most of them provide some sort of socket mounting device so that the sockets in individual lamps or lights may be held in pre-determined array positions.

The devices of some of the afore-mentioned patents are flexible, allowing the apparatus to be deformed into a particular design. In most of these designs, the wiring and bulb sockets are visible. This may detract from the overall appearance of the design. U.S. Pat. Nos. 3,404,268; 3,836,760 and 4,439,818 do disclose mounting apparatus which provides a mask or cover for wiring and light sockets. However, the apparatus of these particular patents appear to require permanent light and wire mounting and do not allow display of conventional strings of electric lights in varying designs and configurations. Furthermore, the designs of the prior art appear to require attachment to the surface of an object such as the wall or eave of a house, etc.

Electric light strings and displays continue to increase in popularity. Their increased use and popularity has resulted in continuing demand for associated apparatus in which lights can be displayed in pre-determined configurations. Continued development in this area appears to be desired.

SUMMARY OF THE PRESENT INVENTION

The present invention provides modular light display apparatus for mounting a string of electric lights of the type having a plurality of light sockets and corresponding light bulbs connected at spaced intervals to electrically conducting wire. In the light display apparatus of the present invention, two or more pre-shaped modular light holders the adjacent ends of which are removably engageable with a stationarily disposed object, provide for mounting the string of electric lights in a display of pre-determined configuration. Each of the modular light holders of the present invention comprises an elongated member of generally U-shaped cross-section so as to provide a channel in which the string of electric lights may be disposed. The elongated member is provided within its channel with a plurality of uniformly spaced holders each one of which is engageable with one of the light sockets of the string of electric lights so that when viewed from at least one side of the modular light holder, the light socket is hidden within the channel and the light bulb projects upwardly from the channel to provide the display of pre-determined configuration.

In a preferred embodiment of the invention, the stationarily disposed object to which adjacent ends of the modular light holders are removably engaged may include a stake which is insertable into the ground and the upper end of which is provided with at least a pair of sockets, each of which is engageable with a corresponding end of one of the modular light holders.

The uniformly spaced holders provided within the channel of the elongated member of the modular light holders may be of several designs. In a preferred embodiment, the uniformly spaced holders may comprise pads projecting away from the walls of the channel and which may be provided with recesses for partially encircling one of the light sockets so that its corresponding light bulb projects upwardly from the channel. In another embodiment, uniformly spaced holders may be provided by elongated slots cut through one wall of the elongated member for slidingly receiving a clip member extending from a light socket of a string of electric lights so that its corresponding light bulb projects upwardly from the channel.

In all embodiments of the modular light display apparatus of the present invention, the light sockets and electrically conducting wire are hidden so that only the light bulbs are seen when arranged in a pre-determined configuration. The modular light display of the present invention is particularly adaptable for use with conventional strings of electric lights allowing for more variation in designs and being generally less expensive than pre-determined design arrangements. Such an arrangement also results in reduced storage space when not in use. Many other objects and advantages of the invention will be apparent from reading the description which follows in conjunction with the accompanying drawings.

DESCRIPTION OF A PREFERRED EMBODIMENT

Figure 1:
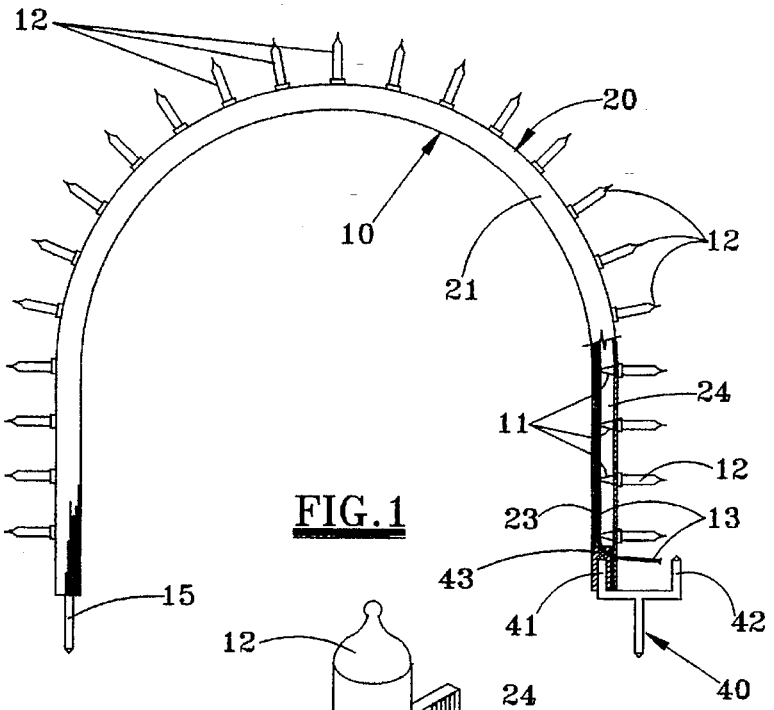
FIG. 1 is a side elevation view of a pre-shaped modular light holder to provide for mounting of a string of electric lights in a display of pre-determined configuration, according to a preferred embodiment of the invention.
Figure 2:
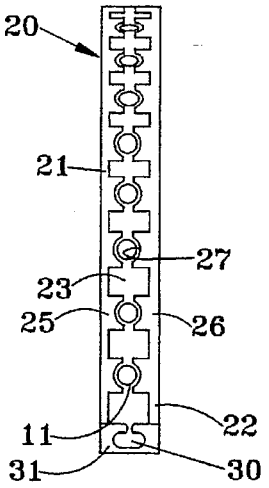
FIG. 2 is an end elevation view of the pre-shaped modular light holder of FIG. 1.
Figure 3:
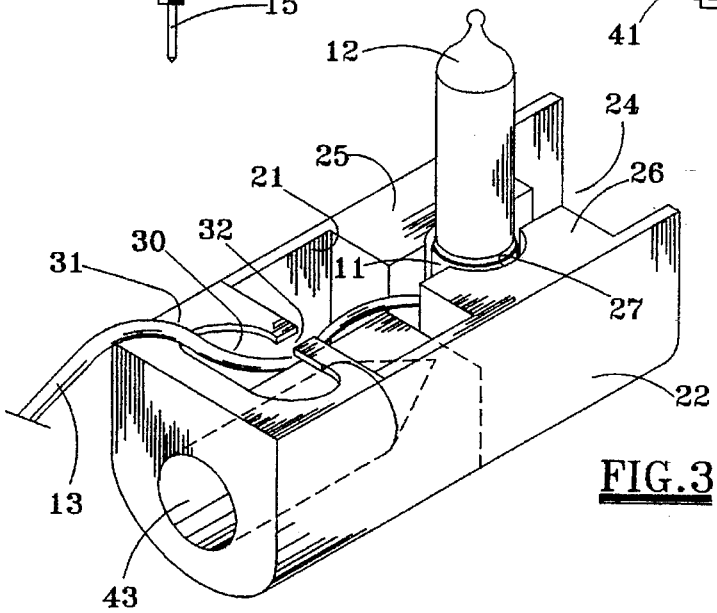
FIG. 3 is an enlarged detail, in perspective, of one end of the pre-shaped modular light holder of FIGS. 1 and 2, illustrating the mounting of individual light sockets and bulbs therein, according to a preferred embodiment of the invention.

Referring first to FIGS. 1–3, there is shown a pre-shaped modular light holder 10 the ends of which are removably engageable with a stationarily disposed object to provide for mounting a string of electric lights in a display of pre-determined configuration. The string of electric lights is the type having a plurality of light sockets 11 and corresponding light bulbs 12 connected at spaced intervals to electrically conducting wire 13.

Each of the modular light holders 10 comprises an elongated member 20 of generally U-shaped cross-section having, for example, a forward wall 21 and a rearward wall 22 connected by a bottom wall 23 to provide a channel in which a string of electric lights may be disposed. The elongated member 20 is provided within the channel 24 with a plurality of uniformly spaced holders engageable with one of the light sockets 11 of the string of electric lights so that when viewed from at least one side of the modular light holder 10, i.e. as in FIG. 1, the light sockets 11 are hidden within the channel 24 and the light bulbs 12 project upwardly from the channel 24 to provide a display of pre-determined configuration.

In the embodiment of FIGS. 1–3, the light holders, as best seen in FIG. 3, comprise receiving pads 25,26 which project away from opposite walls 21,22 of the elongated member 20. The pads 25,26 are preferably provided with recesses, e.g. 27, for receiving and partially encircling one of the light sockets 11 so that its corresponding light bulb 12 projects upwardly from the channel 24. Actually the pads 25,26 may simply be formed by increasing the wall thickness of the walls 21,22. In any case the light socket 11 may be removably placed within the holder area between the walls 21,22.

In the embodiment of FIGS. 1–3, each end of the elongated member 20 may also be provided with a wire receiving aperture 30 through which the electrical conducting wire 13 may extend from the channel 24 for engagement with a similar aperture in an adjoining light holder. The wire receiving aperture 30 may be provided with a web member 31 which is disposed across the channel 24 and provided with a slot 32 which communicates with the aperture 30. The electrically conducting wire 13 may be inserted through the slot 32 for removable placement within the aperture 30. The width of the slot 32 is preferably less than the major dimension of the aperture 30.

As previously mentioned, the adjacent ends of the modular light holder 10 are removably engageable with stationarily disposed objects, e.g. the ground. In the embodiment of FIG. 1, one end of the modular light holder 10 is provided with a prong 15 which may be insertable into the ground (the stationarily disposed object). Or, the stationarily disposed object may be provided with a stake such as the stake 40 illustrated at the opposite end of the modular light holder of FIG. 1. This stake may be insertable into the ground and the upper end of the stake 40 may be forked to provide at least a pair of upwardly directed prongs 41 and 42 each of which is engageable with a corresponding socket provided on adjacent ends of modular light holders. The socket 43 of the modular light holder 10, as best seen in FIG. 3, is simply a socket which is correspondingly shaped and sized to receive the prong 41 in a sliding fit.

Figure 4:
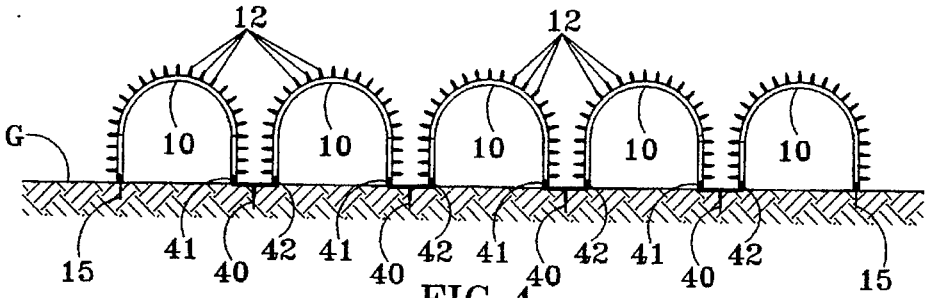
FIG. 4 is an elevation view of a modular light display in which five pre-shaped modular light holders, similar to those shown in FIGS. 1–3, are arranged in a display of pre-determined configuration, according to a preferred embodiment of the invention.

As shown in FIG. 4, several of the modular light holders 10 are arranged in a display of pre-determined configuration by engaging the ends thereof with the upwardly extending forks 41,42 of corresponding stakes 40 such as the stake 40 of FIG. 1. The particular light holders 10 which form the ends of the display may be provided with prongs 15 or simply not attached to anything.

Figure 5:
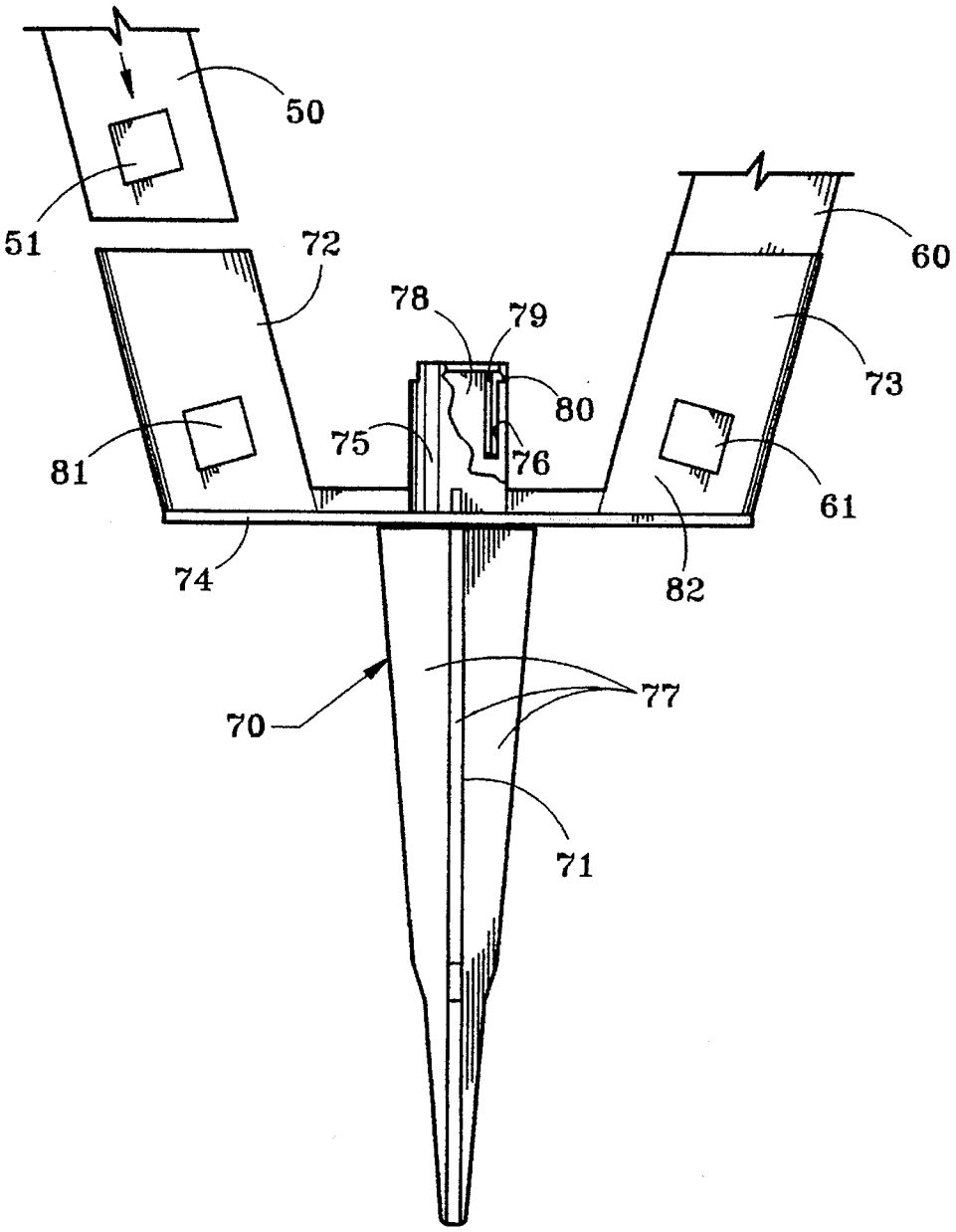
FIG. 5 is a side elevation view of a stake type stationarily disposed mounting for supporting pre-shaped modular light holders, according to a preferred embodiment of the invention.
Figure 6:
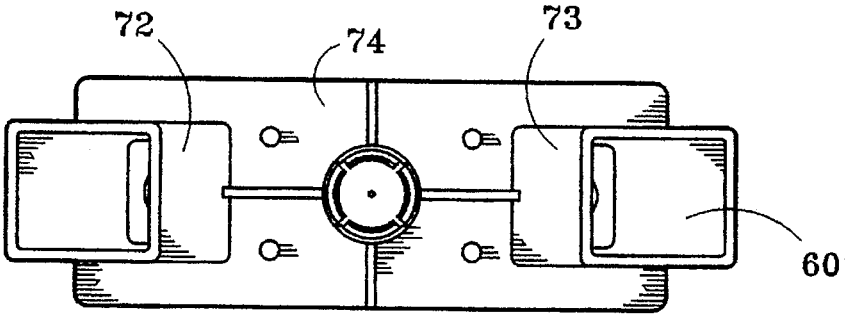
FIG. 6 is a top view of the modular light holder mounting of FIG. 5 illustrating the mounting of a light holder therein.

Referring now to FIGS. 5 and 6, there are shown the ends of modular light holders 50 and 60 and a stationarily fixed disposed object or mounting 70 according to another preferred embodiment of the invention. In this design the stationarily disposed object 70 or mounting comprises a stake 71 insertable into the ground G and at the upper end of which is provided a pair of sockets 72, 73. Each one of these sockets 72, 73 is removably engageable by one end of a corresponding modular light holder 50, 60. The sockets 72, 73 may be attached to a common plate 74 centrally disposed in which is an upwardly projecting tubular portion 75 providing a cylindrical opening 76.

The stake 71 may actually be a separate member which is tapered or pointed for insertion into the ground G. The stake 71 may actually be formed of tapered webs 77, four of which are disposed at right angles to each other in the exemplary embodiment of FIG. 5. At the upper end of the tapered portion of the stake 71 may be provided a tubular extension 78 which may be cut with longitudinal slots 79 which allows segments of the extension 78 to be contracted. Some of these segments are provided with radially extending lugs 80 which cooperate with notches 83 in the upwardly extending tubular portion 75 to latch the stake 71 and the plate 74, to which the socket 72 and 73 are attached, together. It will also be noted that the ends of the modular light holders 50 and 60 are also provided with lugs 51 and 61 which are engageable with corresponding holes 81, 82 in sockets 72 and 73 to latch the modular light members 50 and 60 in place. Each of the modular light holders 50 and 60 are U-shaped in cross-section, such as the modular light holder 10 of FIGS. 1, 2 and 3. Thus, the sides of the modular light holders 50, 60, may be pressed inwardly to allow insertion into the socket 72 and 73, springing outwardly when they reach full engagement with the sockets, as illustrated with the modular light holder 60 and socket 73 in FIG. 5, so that the lugs 51, 61 then spring outwardly to engage the corresponding holes 81, 82 in the socket 72, 73.

In installing the modular light apparatus of FIGS. 5 and 6, the stake portion 71 of the stationarily disposed object 70 is preferably pushed into the ground by itself. Then the plate member 74 and the sockets 72, 73 attached thereto are attached to the stake portion 71 by engaging the upper extension 78 with the cylindrical interior 76 of the upwardly extending tubular portion 75. As this occurs and as pressure is applied, the slotted ends of the extension 78 are pressed inwardly allowing the lugs 80 to move through the tubular member 75 until they reach the position of FIG. 5 to spring outwardly and latch these two members together.

Then the ends of the modular members 50, 60 are inserted into the corresponding socket 72, 73. The modular member 50 is depicted before insertion. As the ends of the modular members 50 and 60 are inserted, they are squeezed or contracted so that the lugs 51 and 61 are allowed to pass into the socket until they reach a position engaging the corresponding locking hole 81, 82 where they spring outwardly into engagement therewith, such as lug 61 with the hole 82 in FIG. 5, locking the corresponding modular light holder 60 in place.

Figure 7:
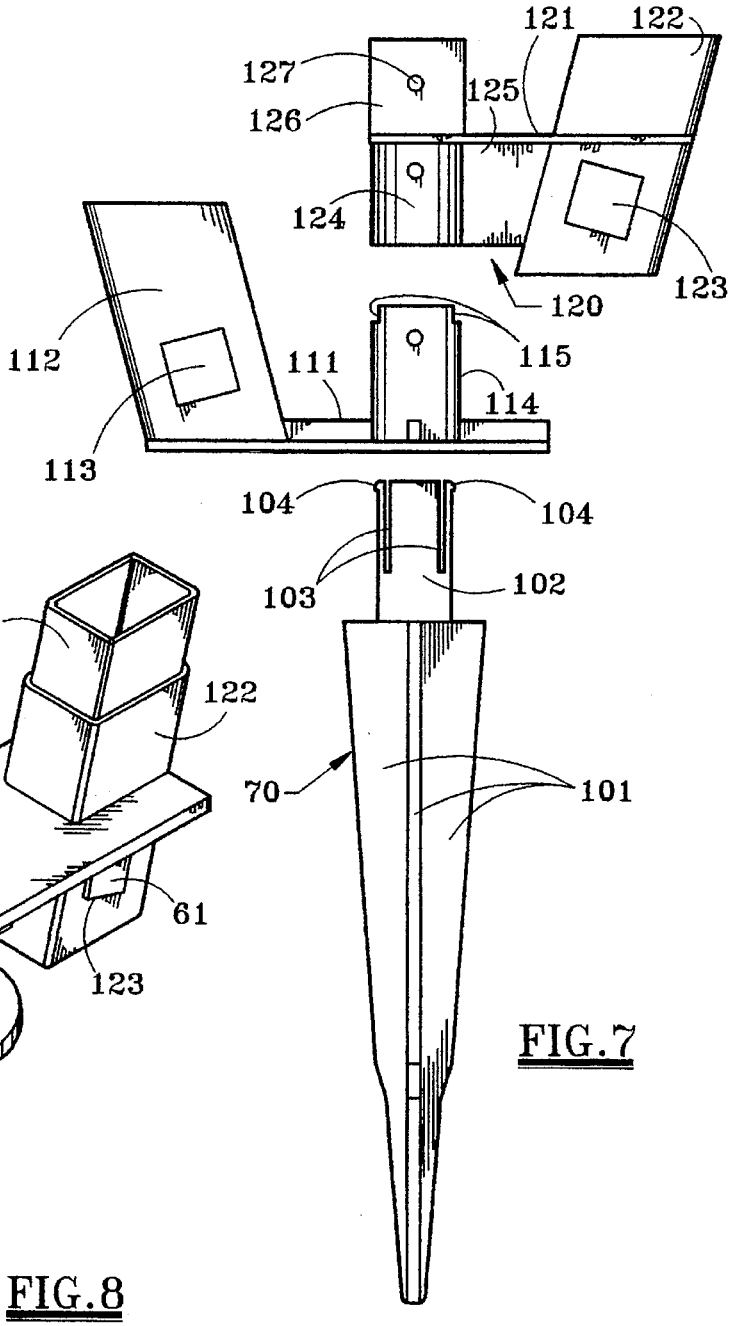
FIG. 7 is an exploded elevation view of a stake type mounting for supporting pre-shaped modular light holders, according to another preferred embodiment of the invention.
Figure 8:
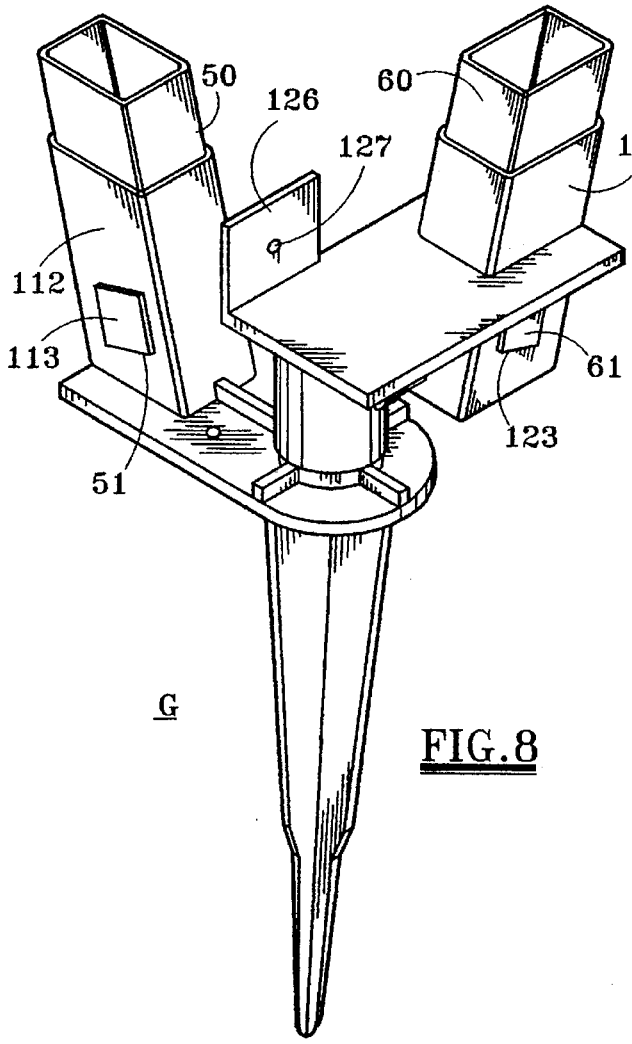
FIG. 8 is a perspective view of the mounting of FIG. 7, showing the disposition thereof for supporting pre-shaped modular light holders, according to a preferred embodiment of the invention.

Referring now to FIGS. 7 and 8, another embodiment of the invention will be shown in which the stationarily disposed object is made up of three composite parts: a stake 101; socket unit 110 and socket unit 120. FIG. 7 illustrates each of these parts separated from the other. The stake 101 is essentially identical to the stake 71 of FIG. 5, having tapered webs, four at ninety degree angles from each other. They are also provided at the upper end thereof with a tubular extension 102. Longitudinal slots 103 allow longitudinal sections of the tubular extension 102 to be contracted inwardly. At least two of the longitudinal sections are provided with radially extending lugs 104.

Socket member 110 has a plate portion 111 upwardly from which extends a tubular socket 112. Holes 113 may be provided in the socket 112. Projecting upwardly from the plate 111 is a tubular extension 114 at the upper end of which is provided notches 115 which correspond with the lugs 104 of the stake member 101. The internal diameter of the tubular extension 114 is slightly greater than the external diameter of the tubular extension 102 of the stake member 101.

The other socket member 120 has a plate member 121 and a tubular socket 122 which is also provided with holes 123. Extending downwardly from the plate member 121 is a tubular extension 124. A supporting web 125 may be connected between the tubular member 124 and the socket member 122. The internal diameter of the tubular member 124 is slightly greater than the external diameter of the corresponding tubular member 114 of the other socket member 110. If desired, a tab 126 with a hole 127 therein may be provided. This allows the socket member 120 to be attached to a flat wall by screw, nail or the like. However, this assembly is primarily designed for attachment to the ground as in the previously described embodiments.

To install the mounting apparatus 100 of FIGS. 7 and 8, the stake member 101 is forced into the ground G as illustrated in FIG. 8 in basically the same fashion as with the embodiment of FIGS. 5 and 6. Next the tubular extension 114 of the socket assembly 110 is pressed downwardly over the tubular extension 102 of the stake member 100 forcing the lugs 104 inwardly until the socket assembly 110 is fully engaged. At this point, the lugs 104 spring outwardly into the notches 115 provided in the upper end of tubular extension 114 of the socket assembly 110. This locks the socket assembly 110 to the stake 110 in a fixed orientation. See FIG. 8.

Next the socket assembly 120 is pressed downwardly over the tubular extension 114 of the socket assembly 110 until the tubular extension 124 of the socket assembly 120 is fully engaged. The tubular extension 124 is rotatable about the common axis of tubular extension 114 of the socket assembly 110 and the stake member 101 so that the socket assembly 120 may be oriented at any number of positions relative to the socket assembly 110. For example in FIG. 8, it is shown rotated to an angle of approximately one hundred and twenty degrees therefrom. Of course it could be positioned directly in line with the socket assembly 110 as with the fixed version of FIGS. 5 and 6. However, the rotatable feature of the socket assembly 120 allows much more flexibility in placement of modular light members therewith. Corresponding holes 118 and 128 in tubular extensions 114 and 124 allow insertion of a pair (not shown) to lock socket assemblies 110, 120 in particular disposition relative to each other. In FIG. 8, one end of a modular light member 50 is inserted into the socket 112 and one end of another modular light holder 60 is inserted into the socket 122. Lugs 51, 61 engage the corresponding holes 113 and 123 provided in sockets 112, 122 to hold the modular light holders 50 and 60 in place.

Thus the modular light display apparatus of the present invention provides a means of mounting a string of electric lights, with a plurality of light sockets and corresponding light bulbs, in a display of predetermined configuration so that when viewed from at least one side, the light sockets and wiring are hidden and the light bulbs project upwardly to provide the display. The modular light holders of the present invention are conveniently designed to receive a conventional string of electric lights in a number of designs. The apparatus is particularly useful in providing displays on the ground and is provided in embodiments which allow varying orientations of the light displays.

Several embodiments of the invention have been described herein. However many variations of these embodiments can be made without departing from the spirit of the invention. Accordingly, it is intended that the scope of the invention be limited only by the claims which follow.

I claim:

1. Modular light display apparatus for mounting a string of electric lights which has a plurality of light sockets and corresponding light bulbs connected at spaced intervals to electrically conducting wire, said light display apparatus comprising two or more pre-shaped modular light holders having ends which are removably engageable with corresponding stationarily disposed objects to provide for mounting of said string of electric lights in a display of predetermined configuration, each of said modular light holders comprising an elongated member having a plurality of uniformly spaced holders each one of which is engageable with one of the light sockets of said string of electric lights so that when viewed from at least one side of said modular light holder said light socket is hidden and said light bulb projects upwardly to provide said display of predetermined configuration, said stationarily disposed objects comprising a stake, having upper and lower ends, said lower end of which is insertable into the ground and said upper end of which is provided with one or more socket members, each of which is slidingly and removably engageable by one end of one of said modular light holders.

2. Modular light display apparatus as set forth in claim 1 in which said stake is provided with an upwardly projecting tubular portion which is engageable with a corresponding tubular portion provided by said socket members.

3. Modular light display apparatus as set forth in claim 2 in which two of said socket members are provided by first and second separate units, said first unit being provided with said corresponding tubular portion and said second unit being provided with another corresponding tubular portion which is surroundingly engageable with said corresponding tubular portion of said first unit.

4. Modular light display apparatus for mounting a string of electric lights which has a plurality of light sockets and corresponding light bulbs connected at spaced intervals to electrically conducting wire, said light display apparatus comprising two or more pre-shaped modular light holders having ends which are removably engageable with corresponding stationarily disposed objects to provide for mounting of said string of electric lights in a display of predetermined configuration, each of said modular light holders comprising an elongated member having a plurality of uniformly spaced holders each one of which is engageable with one of the light sockets of said string of electric lights so that when viewed from at least one side of said modular light holder said light socket is hidden and said light bulb projects upwardly to provide said display of predetermined configuration, said stationarily disposed objects comprising a stake, having upper and lower ends, said lower end of which is insertable into the ground and said upper end of which is provided with one or more socket members removably engageable by one end of one of said modular light holders, each of said socket members being provided with holes which are engageable by corresponding lugs provided on the ends of said modular light holder to lock said light holders to said stationarily disposed object.

5. Modular light display apparatus for mounting a string of electric lights which has a plurality of light sockets and corresponding light bulbs connected at spaced intervals to electrically conducting wire, said light display apparatus comprising two or more pre-shaped modular light holders having ends which are removably engageable with corresponding stationarily disposed objects to provide for mounting of said string of electric lights in a display of predetermined configuration, each of said modular light holders comprising an elongated member having a plurality of uniformly spaced holders each one of which is engageable with one of the light sockets of said string of electric lights so that when viewed from at least one side of said modular light holder said light socket is hidden and said light bulb projects upwardly to provide said display of predetermined configuration, said stationarily disposed objects comprising a stake, having upper and lower ends, said lower end of which is insertable into the ground and said upper end of which is provided with one or more socket members, each of which is removably engageable by one end of one of said modular light holders, said stake being provided with an upwardly projecting tubular portion which is engageable with a corresponding tubular portion provided by said socket members, an upper end of said stake tubular portion being provided with lug means engageable with notch means in an upper end of said corresponding tubular portion provided by said socket members to lock said stake and socket members together.

6. Modular light display apparatus for mounting a string of electric lights which has a plurality of light sockets and corresponding light bulbs connected at spaced intervals to electrically conducting wire, said light display apparatus comprising two or more pre-shaped modular light holders having ends which are removably engageable with corresponding stationarily disposed objects to provide for mounting of said string of electric lights in a display of predetermined configuration, each of said modular light holders comprising an elongated member having a plurality of uniformly spaced holders each one of which is engageable with one of the light sockets of said string of electric lights so that when viewed from at least one side of said modular light holder said light socket is hidden and said light bulb projects upwardly to provide said display of predetermined configuration, said stationarily disposed objects comprising a stake, having upper and lower ends, said lower end of which is insertable into the ground and said upper end of which is provided with one or more socket members, each one of which is removably engageable by one end of one of said modular light holders.

7. Modular light display apparatus as set forth in claim 6 in which said stake is provided with an upwardly projecting tubular portion which is engageable with a corresponding tubular portion provided by said socket members.

8. Modular light display apparatus as set forth in claim 7 in which a pair of said one or more socket members is provided, one of said socket members being provided with said corresponding tubular portion and the other of said socket members being provided with another corresponding tubular portion which is surroundingly engageable with said first mentioned corresponding tubular portion.

9. Modular light display apparatus as set forth in claim 7 in which said upper end of said stake tubular portion is provided with lug means engageable with notch means in the upper end of said socket member tubular portion to lock said stake and socket members together.

10. Modular light display apparatus as set forth in claim 6 in which said socket members are provided with holes which are engageable by corresponding lugs provided on said ends of said modular light holder to lock said light holders to said stationarily disposed object.

* * * * *